US007798836B2

(12) United States Patent
Lappoehn

(10) Patent No.: US 7,798,836 B2
(45) Date of Patent: Sep. 21, 2010

(54) ELECTRIC PLUG CONNECTOR WITH HERMAPHRODITE CONTACT ELEMENT

(75) Inventor: Juergen Lappoehn, Gammelshausen (DE)

(73) Assignee: ERNI Electronics GmbH, Adelberg (DE)

( * ) Notice: Subject to any disclaimer, the term of this patent is extended or adjusted under 35 U.S.C. 154(b) by 29 days.

(21) Appl. No.: 12/218,493

(22) Filed: Jul. 15, 2008

(65) Prior Publication Data

US 2009/0047816 A1 Feb. 19, 2009

(30) Foreign Application Priority Data

Aug. 13, 2007 (DE) ..... 10 2007 038 221

(51) Int. Cl.
*H01R 25/00* (2006.01)

(52) U.S. Cl. ..... 439/291

(58) Field of Classification Search ..... 439/74, 439/66, 291, 20, 284, 289
See application file for complete search history.

(56) References Cited

U.S. PATENT DOCUMENTS 5,127,839 A * 7/1992 Korsunsky et al. ..... 439/79
5,199,885 A * 4/1993 Korsunsky et al. ..... 439/79
5,376,009 A * 12/1994 Olsson et al. ..... 439/67
5,498,167 A * 3/1996 Seto et al. ..... 439/74
5,876,217 A * 3/1999 Ito et al. ..... 439/74
5,975,916 A * 11/1999 Okura ..... 439/74
6,540,529 B1 4/2003 Yu
6,996,670 B2 * 2/2006 Delaire et al. ..... 711/114
7,118,388 B2 * 10/2006 Midorikawa et al. ..... 439/74
7,410,364 B2 * 8/2008 Kishi et al. ..... 439/74

FOREIGN PATENT DOCUMENTS

DE 693 06 903 5/1997
DE 198 09 881 9/1999

* cited by examiner

*Primary Examiner*—Neil Abrams
*Assistant Examiner*—Harshad C Patel
(74) *Attorney, Agent, or Firm*—Collard & Roe, P.C.

(57) ABSTRACT

An electric plug connector with hermaphrodite contact elements (100) having the following features: an electric contact element (100) of a first plug connector opens toward a second electric contact element (100) like a fork, the inner surfaces of the forks, which comprise two legs (110, 120) each, embrace at least in part one leg (120, 110) of the matching other contact element, and is characterized by the following features: one of the two legs (110) comprises a projection of convex shape (111); the other one of the two legs (120) comprises a concave recess (121); and the shape of the concave recess (121) is adapted to the convex projection (111) so that in the engaged condition of two plug connectors the convex projection (111) of the first plug connector is in positive contact, at least in part, with the concave recess (121) of the second plug connector, or vice versa.

13 Claims, 3 Drawing Sheets

ELECTRIC PLUG CONNECTOR WITH HERMAPHRODITE CONTACT ELEMENT

CROSS REFERENCE TO RELATED APPLICATIONS

Applicant claims priority under 35 U.S.C. §119 of German Application No. 10 2007 038 221.0 filed Aug. 13, 2007.

The present invention relates to an electric plug connector with hermaphrodite contact elements as defined in the preamble of Claim 1.

Further, the invention relates to a plug comprising such plug connectors.

PRIOR ART

A plug connector of the described species has been disclosed for instance by DE 198 09 881 A1. Such plug connectors provide an advantage not only in that they are easy to handle and universally applicable, but also and more importantly in that they are easy to produce. In any case, only one type of contact element and one type of insulating shell need to be produced. The fork-like configuration of the contact elements, where the electric contact element of a first plug connector opens like a fork toward the electric contact element of a second plug connector, and where the inner surfaces of the two legs of the fork embrace at least one leg of the matching other contact element, at least in part, ensures well-defined and secure electric contact-making in the plugged-in condition.

However, in the case of the electric plug connector known from DE 198 09 881 A1, contact is made only along a line or by points.

Further, the contact elements of the plug connector disclosed by DE 198 09 881 A1 provide practically no retaining force in the connected, i.e. engaged condition of two plug connectors.

Now, it is the object of the present invention to improve a plug connector of the described species so that on the one hand the contact width (i.e. the contact area in the engaged condition of two electric plug connectors) will be enlarged and, on the other hand, a retaining force will be provided by the contact elements in the engaged condition of two electric plug connectors.

ADVANTAGES OF THE INVENTION

That object is achieved by an electric plug connector with hermaphrodite contact elements having the features defined in Claim 1.

The particular design where one of the two legs comprises a projection of convex shape and the other one of the two legs comprises a concave recess adapted to the convex projection so that in the engaged condition of two plug connectors the convex projection of the first plug connector is in positive contact, at least in part, with the concave recess of the second plug connector, or vice versa, on the one hand advantageously allows the contact width to be considerably enlarged because two-dimensional contact-making is rendered possible in the area of positive contact between the two contact elements, where an extensive contact area is formed. On the other hand, the convex projection and the matching concave recess further provide sort of a snap-in connection between the contacts and, thus, a substantially increased retaining force—in contrast to the retaining function of the two contact elements of the prior art design where that function is provided merely by pre-stress and mainly by friction. Thus, the interaction between the convex projection and the concave recess on the matching legs of different plug connectors achieves two substantial advantages at the same time, namely an improvement of the retaining force and an enlargement of the contact width.

Further advantages and features of the invention are the subject-matter of the sub-claims that refer back to Claim 1.

For example, the leg provided with the convex projection is curved in the form of an arc. That curved configuration, for example in a substantially mirrored S shape, provides a very advantageous spring effect. The curved design of that example is selected so that the curvature points away from the contact element provided with the concave recess of the respective matching plug connector so that a space, for example substantially in the form of an "O", is enclosed between the curvature and the recess. One achieves in this way an especially good spring effect toward the concave recess.

In order to ensure simple and easy fitting, the convex projection advantageously is given a tulip shape. During fitting, the tulip shape ensures that the contact element carrying the convex projection will sort of slide over the contact element provided with the concave recess during the fitting operation, being urged in outward direction by the element with the convex projection at the beginning of the fitting operation, due to the tulip-shaped design of that element. This also excludes the risk of mismatches that may cause damage to the contact elements. Due to the rounded shape of both the contact element with the convex tulip-shaped projection and the contact element with the concave recess, optimum sliding is rendered possible and any canting, mechanical sticking, or the like, is prevented very effectively.

Preferably, the leg with the concave recess has a flat surface on its side opposite the concave recess. Advantageously, the leg with the concave recess has a width such that the plane surface rests against the flat surface of the respective contact element of the second plug connector in the connected condition, i.e. in the condition where the two plug connectors are engaged one in the other. That contact between those flat surfaces again results in a large-area electric contact and, thus, advantageous electric contact-making.

One advantageous embodiment provides that the footing area of the two legs, converging in the form of an arc, shows a constriction at its transition to a solder terminal for boards. This results in an especially good spring effect of the two legs. The spring effect also allows for compensation of positional tolerances of the two plug connectors one relative to the other.

With a view to achieving the best possible and electrically perfect assembly, it is provided that the lower solder terminal area has a plane or line-type configuration and, preferably, a larger width than the insulating shell.

In order to achieve easy and yet secure mounting of the electric contact elements in an insulating shell it is provided according to an advantageous embodiment that the free end faces of the insulating shell of each plug connector are provided with guide elements for mutual centering during the fitting operation.

In order to obtain a large supporting surface in the fitted condition of the two plug connectors, it is further provided with advantage that a predominantly flat surface is formed in the upper area of the insulating shell, outside of the contact area.

In order to allow easy and quick fastening and, especially, mounting of the plug connector on a board, with correct polarity, one advantageous embodiment provides that the side of the insulating shell facing the solder terminal area is provided with mounting pins that fit into corresponding openings of the board on which the plug is to be fastened.

As has been mentioned before, the electric plug connector distinguishes itself by the fact that a single type of electric contact elements and a single type of insulating shell have to be provided only. An especially advantageous solution is obtained when the contact elements are made from a flat material, especially by punching. This is a decisive advantage especially under aspects of mass production.

DESCRIPTION OF THE DRAWING

Further advantages and features of the invention are the subject-matter of the description that follows and of the illustrations of one embodiment.

In the drawing.

DESCRIPTION OF CERTAIN EMBODIMENTS OF THE INVENTION

Figure 1:
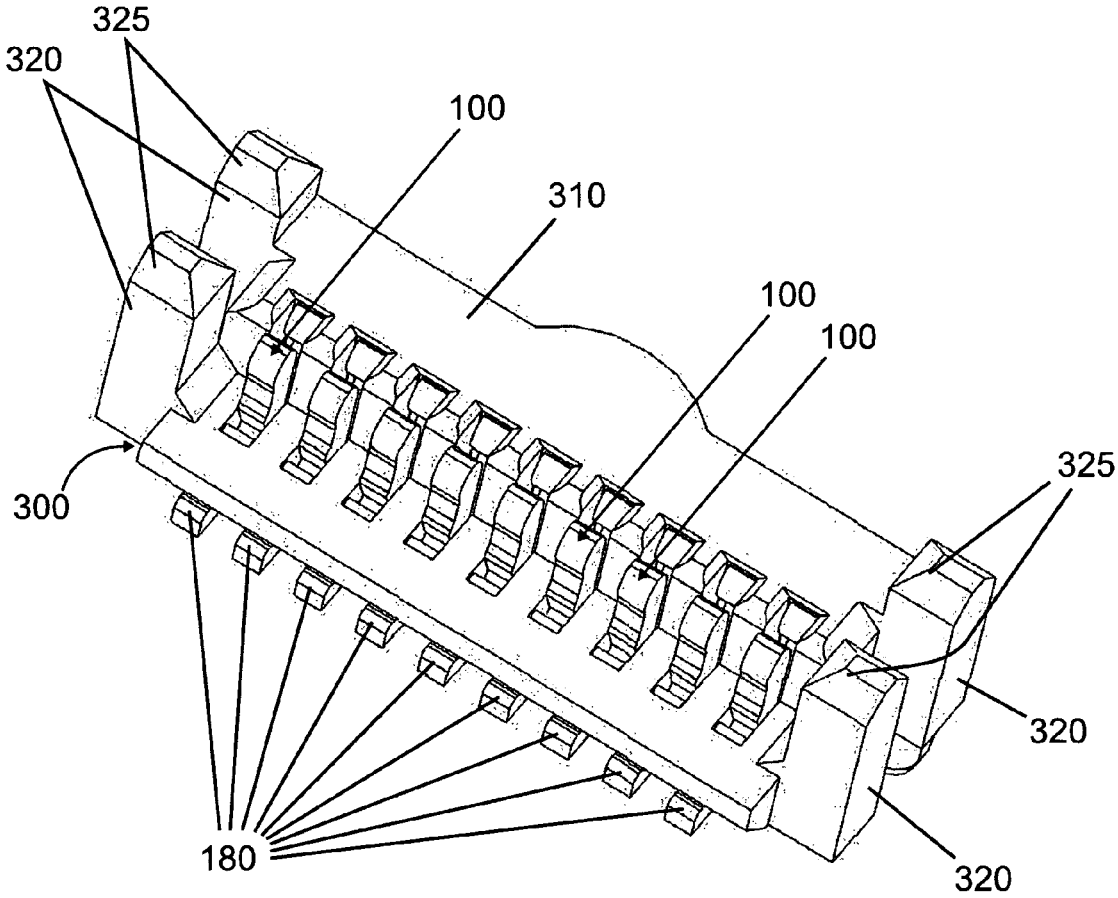
FIG. 1 shows an isometric representation of a plug connector incorporating the invention.

One embodiment of an electric plug connector with hermaphrodite contact elements according to the invention, illustrated in FIG. 1, comprises a plurality of contact elements mounted one beside the other in an insulating shell 300, for example a plastic shell 300. Their lower ends are provided with plane and line-type solder terminal areas 180 of, preferably, greater width than the insulating shell 300 as such, so that they project laterally beyond the shell (compare FIG. 3 where two engaged electric plug connectors are shown).

The plane or line-type configuration has the decisive advantage to provide a large solder joint area which ensures, on the one hand, high mechanical strength and, on the other hand, good electric conductivity.

Figure 3:
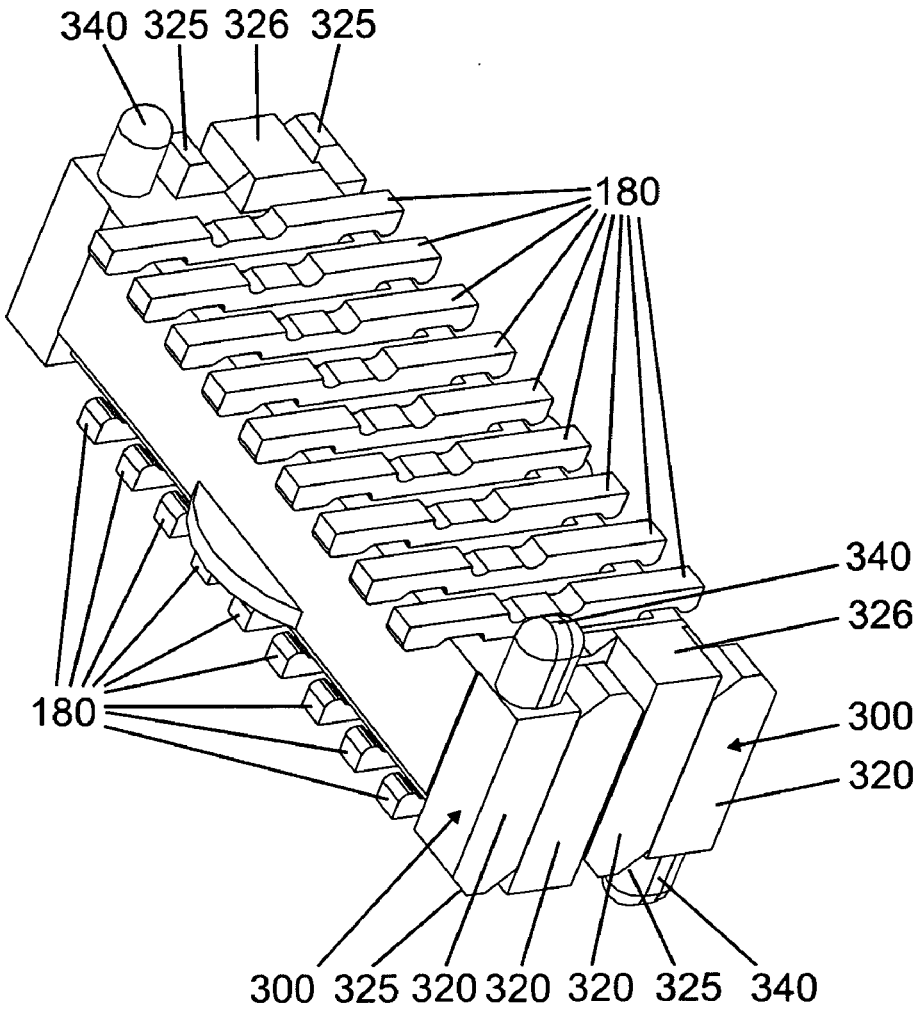
FIG. 3 shows an isometric representation of two plug connectors engaged one in the other.

As can be seen in FIG. 1, the shell 300 comprises in its upper portion a flat surface 310 that serves as a supporting surface for the solder terminal areas 180 projecting beyond the shell, in the engaged condition of two plug connectors (refer also to FIG. 3).

Further, guide elements 320 are formed on the end faces of the insulating shell 300 for mutually centering two such plug connectors during the fitting operation.

The guide elements 320 taper conically on their upsides, viewed in the plug-in direction, for example in the form of a truncated pyramid 325, in order to achieve optimum engagement, whereas their sides facing a board or circuit board 401, 402 (FIG. 3) are provided with flat surfaces 326 in order to obtain the largest possible supporting surface.

As can be seen especially in FIG. 3, the insulating shell 300 encloses the entire contact area of an engaged pair of plug connectors, which will be described in more detail hereafter, so that there is no risk of dirt entering the contact area or of electric failures, for example short-circuits. And the contact area is also electrically insulated in this way.

Figure 2:
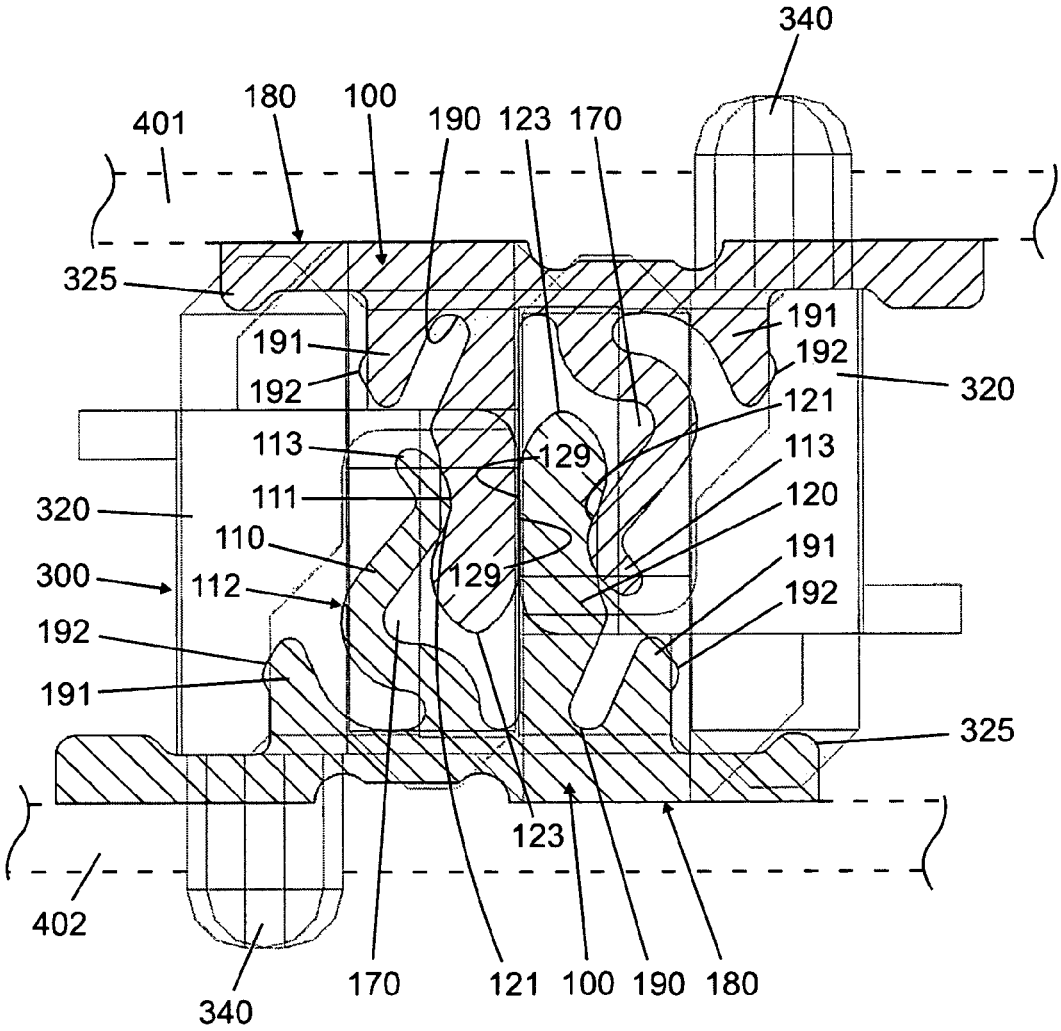
FIG. 2 shows a sectional view of two plug connectors according to the invention, engaged one in the other.

As can be further seen in FIG. 2 and FIG. 3, the insulating shell 300 is provided, on its side facing the solder terminal areas 180, with mounting pins 340 fitting into corresponding openings in a board, for precisely fitting a plug connector of the described kind in the openings and, on the other hand, for fixing the connector in that position (FIG. 2).

The hermaphrodite contact elements of an electric plug connector of that kind will now be described in more detail with reference to FIG. 2.

The contact elements 100 are each formed from a flat material, for example by punching, and have a plane surface over the entire surface area (parallel to the plane of the drawing). Each contact element 100 is formed by two differently configured legs 110 and 120 in the form of a fork opening toward a second pair of legs of identical design, for receiving such a pair of legs in the engaged condition—as is shown in FIG. 2.

One of the two legs 110 comprises a convex projection 111 in its upper portion. The other one of the two legs 120 comprises a concave recess 121 which has its shape adapted to the convex projection 111 so that in the engaged conditions of two such plug connectors—as shown in FIG. 2—the convex projection 111 is in positive contact with the concave recess 121, at least in part, whereby contact is made over a two-dimensional area. In addition to enlarging the contact width, i.e. the contact area, compared with the plug connector known from the prior art and described for example by DE 198 09 881 A1, such design of the two legs also improves the retaining force by which the two plug connectors are retained one against the other. This is so because the convex projection 111 and the concave recess 121, in combination with the spring effect of the pre-stressed legs, form together sort of a snap-in connection. That snap-in connection is achieved in an especially advantageous way also by the fact that the leg 110 comprising the convex projection 111, is curved in the form of an arc, with the arc pointing away from the leg 120 provided with the concave recess 120, thereby forming a space 170 together with the latter. That curved configuration of the leg 120 provides an especially good spring effect, the retaining force is increase, and the leg 110 is pre-stressed—as has been mentioned before—which pre-stress can be adjusted by suitable selection of the material, the shape of the arc, and the like.

The forward end of the leg 110 with the convex projection 111 is configured in the form of a contact tulip 113 and is rounded. The upside of the leg 120 with the concave recess has a rounded configuration and a rounded or sloping surface 123 or a surface profiled in a similar way. The configuration 113 of the first leg 110 in the form of a contact tulip, and the rounded, sloping or similarly profiled surface 123 of the second leg 120 allow two plug connectors of that kind to be easily fitted one in the other without any canting, mechanical sticking, or the like. Instead, the two legs 110, 120 will slide along each other during the fitting operation, and as the leg 110 slides over the rounded surface 123 it will be urged a little to the outside, i.e. away from the leg 120, that movement being optimally supported by the pre-stressed arc 112, for finally snapping in one against the other, in the extended condition, by the projection and the recess.

The legs 120 comprising the concave recess 121 each have a flat surface 129 on their side opposite the concave recess. The width of the contact elements 120 is such that in the engaged condition of two contact elements 100 the flat surfaces 129 of two adjacent legs 120 are in contact one with the other, thereby making contact over a two-dimensional area at this point as well.

FIG. 2 shows two plug connectors of that kind in the completely engaged condition in which they electrically connect and electrically contact two boards 401, 402. As has been described before, the plane solder terminal areas 180 rest on corresponding contact elements of the boards 401, 402 and are fixed in that condition (by a solder joint).

Each fork-shaped pair of contact legs is provided with a constriction 190 on its lower surface opposite the solder terminal area 180. This provides an especially good spring effect of the two legs 110, 120. In addition, that configuration allows for compensation of positional tolerances of the two plug connectors one relative to the other.

In the embodiment illustrated in FIG. 2, outwardly directed arms 191 are provided on both sides of the constriction 190, which arms are provided with noses 192 for fixing the metallic contact elements 100 in the insulating shell 300 as the contact elements 100 are pressed into the insulating shell 300. In this way, the contact elements 100 are fixed and retained undetachably in the insulating shell.

The invention claimed is:

1. An electric plug connector assembly comprising:

(a) a first plug connector comprising a first hermaphrodite electric contact element having first and second legs, each of the first and second legs having a respective first plug connector inner surface;

(b) a second plug connector comprising a second hermaphrodite electric contact element having third and fourth legs, each of the third and fourth legs having a respective second plug connector inner surface;

wherein the first hermaphrodite electric contact element is identical to the second hermaphrodite electric contact element;

wherein the first hermaphrodite electric contact element opens toward the second hermaphrodite electric contact element like a fork;

wherein the first plug connector inner surfaces embrace at least in part one of the third and fourth legs;

wherein each of the first and third legs comprises a respective projection of convex shape and each of the second and fourth legs comprises a respective concave recess; and wherein the shape of each concave recess is adapted to each convex projection so that in an engaged condition of the first and second plug connectors the convex projection of the first leg is in positive contact, at least in part, with the concave recess of the fourth leg or the convex projection of the third leg is in positive contact, at least in part, with the concave recess of the second leg;

wherein each of the second and fourth legs has a flat surface on a side of the second and fourth legs, respectively, opposite the concave recess; and wherein each of the second and fourth legs has a width such that the flat surfaces of the second and fourth legs rest against each other in the engaged condition, establishing electric contact in this way.

2. The electric plug connector assembly as defined in claim 1, wherein each of the first and third legs is curved in the form of an arc.

3. The electric plug connector assembly as defined in claim 1, wherein at least one leg of each of the first and second plug connectors has a rounded or sloping surface at least in part.

4. The electric plug connector assembly as defined in claim 1, wherein each convex projection has a tulip shape.

5. The electric plug connector assembly as defined in claim 1, wherein each leg has a footing area comprising a constriction at a transition of each leg to a solder terminal for boards.

6. The electric plug connector assembly as defined in claim 5, wherein outwardly directed arms extend on both sides of each constriction, each outwardly directed arm comprising a respective nose for fixing the electric contact element as the electric contact element is pressed into an insulating shell.

7. The electric plug connector assembly as defined in claim 1, wherein a lower solder terminal area has a plane or line-type configuration and a larger width than an insulating shell so that the lower solder terminal area projects laterally beyond the insulating shell.

8. The electric plug connector assembly as defined in claim 7, wherein a side of the insulating shell facing the lower solder terminal area is provided with mounting pins.

9. The electric plug connector assembly as defined in claim 1, wherein each plug connector has an insulating shell with free end faces and the free end faces of the insulating shell of each plug connector are provided with guide elements for mutual centering during the fitting operation.

10. The electric plug connector assembly as defined in claim 9, wherein a predominantly flat surface is formed in an upper area of the insulating shell outside of a contact area.

11. The electric plug connector assembly as defined in claim 10, wherein the insulating shells of an engaged pair of plug connectors enclose the entire contact area of the contact elements.

12. The electric plug assembly as defined in claim 9, wherein each plug connector has a plurality of hermaphrodite contact elements arranged one adjacent the other in the insulating shell.

13. The electric plug connector assembly as defined in claim 1, wherein each contact element is made from a flat material.

* * * * *